US007557513B2

(12) United States Patent
Ohta et al.

(10) Patent No.: US 7,557,513 B2
(45) Date of Patent: Jul. 7, 2009

(54) DISCHARGE LAMP LIGHTING CIRCUIT

(75) Inventors: Shinji Ohta, Shizuoka (JP); Tomoyuki Ichikawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/780,125

(22) Filed: Jul. 19, 2007

(65) Prior Publication Data

US 2008/0018263 A1 Jan. 24, 2008

(30) Foreign Application Priority Data

Jul. 20, 2006 (JP) ..... 2006-198535

(51) Int. Cl.
*H05B 41/00* (2006.01)

(52) U.S. Cl. ..... 315/177; 315/254; 315/257; 315/341

(58) Field of Classification Search ..... 315/177, 315/246, 247, 254, 257, 258, 274, 279, 283, 315/326, 341; 307/10.8; 323/235, 238
See application file for complete search history.

(56) References Cited

U.S. PATENT DOCUMENTS 5,212,428 A * 5/1993 Sasaki et al. ..... 315/308
2006/0055346 A1* 3/2006 Ohta et al. ..... 315/291
2007/0229002 A1 10/2007 Cho et al.

FOREIGN PATENT DOCUMENTS

| | | |
|---|---|---|
| JP | 04-141988 | 5/1992 |
| JP | 2005-063823 | 3/2005 |
| KR | 10-0342457 | 11/2002 |
| KR | 10-2006-0027421 | 3/2006 |
| WO | 95/22194 | 8/1995 |

* cited by examiner

*Primary Examiner*—Douglas W Owens
*Assistant Examiner*—Jianzi Chen
(74) *Attorney, Agent, or Firm*—Fish & Richardson P.C.

(57) ABSTRACT

A lighting circuit includes a capacitor and inductor for a resonance, and a first output, a second output, a resistor and a monitor circuit. A DC-AC converting circuit generates an AC voltage from a DC voltage. The resistor has an end connected to the second output and the other end connected to an end of a secondary winding. A monitoring output is connected to the other end of the resistor, and is provided for providing a signal for monitoring a current flowing to a discharge lamp. The end of the resistor is connected to a grounding conductor GND. The monitor circuit receives a signal from the monitoring output. The monitor circuit generates a signal for monitoring a current IL flowing to the discharge lamp.

6 Claims, 9 Drawing Sheets

DISCHARGE LAMP LIGHTING CIRCUIT

TECHNICAL FIELD

The present disclosure relates to a discharge lamp lighting circuit.

BACKGROUND ART

Japanese Patent Document JP-A-4-141988 describes a lighting circuit of a discharge lamp for a vehicle. The lighting circuit uses a DC booster circuit to raise a voltage applied from a battery. A boosting output of the DC booster circuit is connected to a high frequency booster circuit. The high frequency booster circuit is a self-excitation type inverter circuit, and an operating frequency thereof is not changed depending on a control signal. The self-excitation type inverter circuit includes a pair of field effect transistors and a transformer. The boosting output of the DC booster circuit is connected to a center tap of the transformer through a choke coil. One of the field effect transistors has a drain connected to one end of a primary winding of the transformer and a source connected to a ground line. The other field effect transistor has a drain connected to the other end of the primary winding of the transformer and a source connected to the ground line. Gates of the field effect transistors are connected to the ends of a feedback winding of the transformer, respectively. One end of a secondary winding of the transformer is connected to an end of the discharge lamp through a trigger transformer, and the other end of the secondary winding of the transformer is connected to the other end of the discharge lamp through a resistor.

There are some lighting circuits of different types from the lighting circuit described in the foregoing document. One of the lighting circuits uses a series resonant circuit together with a DC-AC converting circuit. The DC-AC converting circuit generates an AC power having a frequency corresponding to a control signal and the transformer raises a voltage generated in the series resonant circuit. One end of a secondary winding of the transformer and the other end are connected to both ends of the discharge lamp, respectively. Furthermore, one end of the secondary winding is grounded. A control signal is generated corresponding to a voltage to be applied to the discharge lamp (which will be hereinafter referred to as a lamp voltage) and a current to flow to the discharge lamp (which will be hereinafter referred to as a lamp current), and controls a power to be applied to the discharge lamp.

In the lighting circuit, for the lamp voltage and the lamp current, a detecting circuit is not provided on a secondary side of the transformer, but a primary side to which a lower voltage than a voltage on the secondary voltage is applied. In order to control a power to be supplied to the discharge lamp with high precision, however, it is necessary to enhance precision in the detection of the lamp voltage and the lamp current. For this reason, it is preferable that a monitor circuit for monitoring a state of the discharge lamp should not be provided on the primary side of the transformer, but rather should be provided on the secondary side. In the lighting circuit, moreover, it is demanded that accurate monitoring be carried out also when a ground is generated between one end of the discharge lamp and the ground.

SUMMARY

In consideration of the foregoing circumstances, the present disclosure describes a lighting circuit capable of accurately monitoring a state of a discharge lamp without the influence of a ground.

An aspect of the invention is directed to a lighting circuit for turning on a discharge lamp. The lighting circuit comprises (a) a DC-AC converting circuit for converting an input DC voltage into an AC voltage in response to a control signal for controlling a power to be applied to the discharge lamp, (b) a transformer including a primary winding and a secondary winding which receive the AC voltage from an output of the DC-AC converting circuit, (c) a capacitor provided on the primary side of the transformer, (d) an inductor provided on the primary side of the transformer, (e) first and second outputs for supplying a power from the secondary winding to the discharge lamp, (f) a resistor having one of ends connected to the second output and grounded and the other end connected to one of ends of the secondary winding, and (g) a detecting circuit including a current monitor circuit for monitoring a current flowing to the discharge lamp by using a signal sent from the other end of the resistor, wherein the capacitor, the inductor and the primary winding are connected in series.

In some implementations, the resistor is connected between the second output and one of the ends of the secondary winding of the transformer. Therefore, it is possible to monitor a current flowing to the discharge lamp on the secondary side of the transformer in place of the primary side thereof. Moreover, one end of the resistor is grounded. Therefore, the detecting circuit receives a signal indicative of a potential difference generated on both ends of the resistor by a current flowing to the secondary winding of the transformer. Also, when a ground is generated in a wiring between an output of the lighting circuit and the discharge lamp, it is possible to accurately monitor the state of the discharge lamp. Therefore, the lighting circuit is controlled corresponding to an accurate monitor value.

In some cases, the secondary winding of the transformer has an intermediate tap, the detecting circuit has a first generating circuit having an input connected to the other end of the resistor and a voltage monitor circuit. The first generating circuit generates a first signal corresponding to an amplitude of the AC voltage at the input, and the voltage monitor circuit includes a second generating circuit having an input connected to the intermediate tap and serving to generate a second signal corresponding to the amplitude of the AC voltage at the input. A first arithmetic circuit is provided for calculating the first signal and the second signal to output a lamp voltage equivalent signal.

In various implementations, a value of an output from the intermediate tap of the transformer is used without directly monitoring a voltage between both of the terminals of the discharge lamp to which a high voltage is applied. Therefore, it is possible to reduce a breakdown performance of a monitor input portion, and furthermore, to cause a signal indicative of the voltage to be applied to the discharge lamp to have high precision. Moreover, one end of the resistor is grounded. Therefore, the value of the output from the intermediate tap of the transformer is a sum of a voltage generated between one end of the secondary winding of the transformer and the intermediate tap and the voltage between both ends of the resistor. By processing the signal sent from the intermediate tap using the first and second generating circuits and the first arithmetic circuit, it is possible to obtain a signal indicative of a voltage to be applied to the discharge lamp from which the influence of the resistor is substantially eliminated.

According to some implementations, the secondary winding of the transformer has an intermediate tap, the detecting circuit has a first generating circuit having an input connected to the other end of the resistor and a voltage monitor circuit, the first generating circuit generates a first signal corresponding to an amplitude of the AC voltage at the input, and the voltage monitor circuit can includes a third generating circuit having a first input connected to the other end of the resistor and a second input connected to the intermediate tap of the secondary winding, and serving to generate a third signal corresponding to a difference between AC signals sent from the first and second inputs, and a second arithmetic circuit for calculating the first signal and the third signal to output a lamp voltage equivalent signal.

According to some implementations, a value of an output from the intermediate tap of the transformer is used without directly monitoring a voltage between both of the terminals of the discharge lamp to which a high voltage is applied. Therefore, it is possible to reduce a breakdown performance of a monitor input portion, and furthermore, to cause a signal indicative of the voltage to be applied to the discharge lamp to have high precision. Moreover, one of the ends of the resistor is grounded. Therefore, the value of the output from the intermediate tap of the transformer is a sum of a voltage generated between one of the ends on the secondary side of the transformer and the intermediate tap and the voltage between both of the ends of the resistor. By processing the signal sent from the intermediate tap of the transformer using the third generating circuit, it is possible to obtain a signal indicative of a voltage generated between one of the ends on the secondary side of the transformer and the intermediate tap. When the signal is further processed by using the second arithmetic circuit, it is possible to obtain a signal from which the influence of a potential difference made by the resistor is substantially eliminated (a signal indicative of a voltage to be applied to the discharge lamp).

In some cases, the secondary side of the transformer has an additional winding, the detecting circuit includes a first generating circuit having an input connected to the other end of the resistor and a voltage monitor circuit, the first generating circuit generates a first signal corresponding to an amplitude of the AC voltage at the input, and the voltage monitor circuit can includes a fourth generating circuit having an input connected to the additional winding and serving to generate a fourth signal depending on an AC voltage corresponding to a potential difference between both ends of the additional winding, and a third arithmetic circuit for calculating the first signal and the fourth signal to output a lamp voltage equivalent signal.

The additional winding can be provided on the secondary side of the transformer and the voltage between both of the terminals of the discharge lamp to which a high voltage is to be applied need not be monitored directly. Therefore, it is possible to reduce the breakdown performance of the monitor input portion and, furthermore, to cause the signal indicative of the voltage to be applied to the discharge lamp to have high precision.

The first generating circuit can include a holding circuit for holding and outputting a signal corresponding to an amplitude of a signal sent from the input of the first generating circuit.

The second generating circuit can include a holding circuit for holding and outputting a signal corresponding to an amplitude of the signal sent from the input of the second generating circuit. Moreover, the third generating circuit can include a holding circuit for holding and outputting a signal corresponding to an amplitude of a signal obtained by differentiating the AC signals sent from the first and second inputs of the third generating circuit. Furthermore, the fourth generating circuit can include a holding circuit for holding and outputting a signal corresponding to an amplitude of the signal sent from the input of the fourth generating circuit.

Other features and various advantages of the invention will be readily apparent from the following detailed description of preferred embodiments, the accompanying drawings and the claims.

DETAILED DESCRIPTION

First Embodiment

Figure 1:
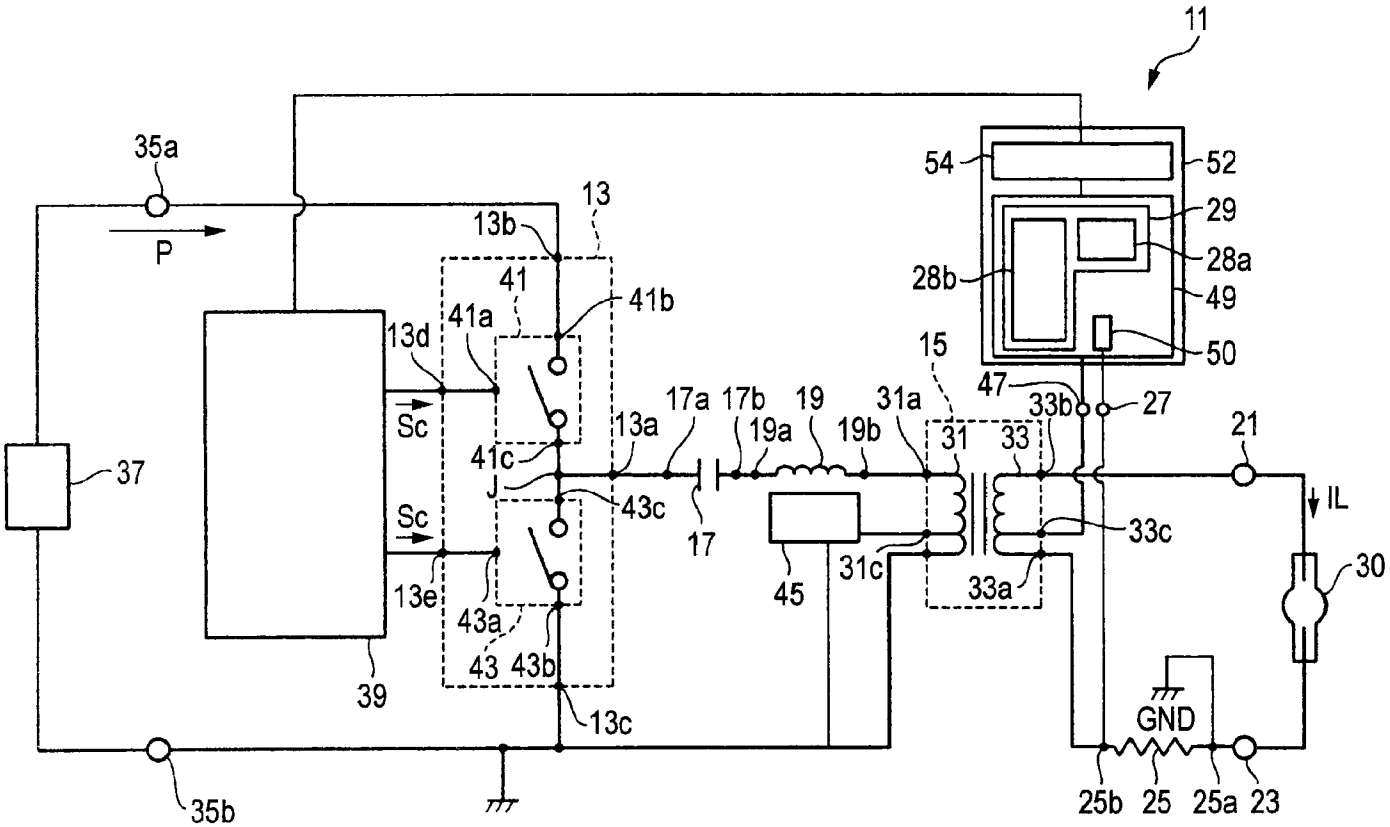
FIG. 1 is a circuit diagram schematically showing an example of a lighting circuit for a discharge lamp for a vehicle, FIGS. 2(*a*) to 2(*d*) are diagrams showing an equivalent circuit in which a ground is generated in the lighting circuit and a circuit constituted by a discharge lamp.

FIG. 1 is a circuit diagram schematically showing a lighting circuit for a discharge lamp for a vehicle. The lighting circuit is used for a lighting unit for a vehicle such as a vehicle headlamp. A lighting circuit 11 comprises a DC-AC converting circuit 13, a transformer 15, a capacitor 17, an inductor 19, a first output 21, a second output 23, a resistor 25 and a monitor circuit 29. The DC-AC converting circuit 13 receives a control signal Sc and a DC voltage, and converts the DC voltage to generate an AC voltage having a frequency corresponding to the control signal Sc. The transformer 15 includes a primary winding 31 for receiving the AC voltage from the DC-AC converting circuit 13 and a secondary winding 33 for supplying a power to a discharge lamp 30 connected to the lighting circuit 11. The capacitor 17 and the inductor 19 are provided on a primary side of the transformer 15. Moreover, the capacitor 17, the inductor 19 and the primary winding 31 are connected in series and are connected to an output 13*a* of the DC-AC converting circuit 13. In the example, the capacitor 17 and the inductor 19 are connected between the output 13*a* of the DC-AC converting circuit 13 and an end 31*a* of the primary winding 31 in the transformer 15, for example. The capacitor 17 has an end 17*a* connected to the output 13*a* of the DC-AC converting circuit 13, and the other end 17*b* connected to an end 19*a* of the inductor 19. Another terminal 19*b* of the inductor 19 is connected to the end 31*a* of the primary winding 31. The first and second outputs 21 and 23 are provided for supplying an AC power from the secondary winding 33 of the transformer 15 to the discharge lamp 30. The resistor 25 has an end 25*a* connected to the second output 23 and the other end 25*b* connected to an end 33*a* of the secondary winding 33. The first output 21 is connected to the other end 33*b* of the secondary winding 33. A monitoring output 27 is connected to the other end 25*b* of the resistor 25 and is provided to give a signal for monitoring a current flowing to the discharge lamp 30. The end 25*a* of the resistor 25 is connected to a grounding conductor GND. By using the lighting circuit 11, the discharge lamp 30 is turned on in an alternating current. The monitor circuit 29 receives a signal from the monitoring output 27. The monitor circuit 29 includes a current monitor circuit 28*a* for monitoring the current flowing to the discharge lamp 30. The current monitor circuit 28*a* generates a signal indicative of a magnitude of an alternating current $IL^{AC}$ flowing to the discharge lamp 30 by using a signal sent from the other end 25*b* of the resistor 25. The current $IL^{AC}$ is deviated from $V_{IL}^{AC}/R1$, where the voltage $V_{IL}^{AC}$ is a potential difference between both ends of the resistor 25 and the resistor 25 has a resistance value R1. The monitor circuit 29 includes a voltage monitor circuit 28*b*.

In the lighting circuit 11, the resistor 25 is connected between the second output 23 and the end 33*a* of the secondary winding 33. Therefore, the current $IL^{AC}$ flowing to the discharge lamp 30 can be monitored on the secondary side of the transformer 15 in place of the primary side thereof. Moreover, the end 25*a* of the resistor 25 is grounded. Therefore, a signal indicative of the potential difference generated on both ends of the resistor 25 through the current flowing to the secondary winding 33 can be provided from the monitoring output 27. Also when a ground is generated in a wiring between the output 23 of the lighting circuit 11 and the discharge lamp 30, accordingly, it is possible to accurately monitor the state of the discharge lamp 30. The lighting circuit 11 is controlled corresponding to an accurate monitor value.

The lighting circuit is now described in more detail. The DC-AC converting circuit 13 has first and second inputs 13*b* and 13*c* connected to first and second power inputs 35*a* and 35*b* of the lighting circuit 11. The first and second inputs 13*b* and 13*c* receive a power P from an external power supply 37 connected to the first and second power inputs 35*a* and 35*b* of the lighting circuit 11. Moreover, the external power supply 37 is a DC power supply, for example, a battery. Alternatively, the external power supply 37 may rectify an AC power and then supply a DC power obtained by smoothing a rectifying waveform. The DC-AC converting circuit 13 also receives the control signal Sc and converts an AC power having a frequency corresponding to the control signal Sc from the power P. The control signal Sc is generated by a driving circuit 39. The driving circuit 39 is operated in response to monitor signals corresponding to the current $IL^{AC}$ flowing to the discharge lamp 30 and an AC voltage $VL^{AC}$ applied to the discharge lamp 30. The frequency of the control signal Sc is changed corresponding to the monitor signals. A value of the frequency can be, for example, approximately 100 kHz to 3 MHz. Moreover, a value of the resistor 25 is 0.1Ω to 1Ω, for example.

The DC-AC converting circuit 13 includes switching units 41 and 43. The conduction and non-conduction of the switching units 41 and 43 is controlled in response to the control signal Sc. The switching units 41 and 43 are connected in series, and a shared node J is connected to the output 13*a* of the DC-AC converting circuit 13. Each of the switching units 41 and 43 can be implemented as a transistor, for example. A field effect transistor and a bipolar transistor can be used as the switching units 41 and 43, for example. The conduction and non-conduction of a first terminal 41*b* and a second terminal 41*c* is controlled in response to a signal applied to a control terminal 41*a* of the switching unit 41. Moreover, the conduction and non-conduction of a first terminal 43*b* and a second terminal 43*c* is controlled in response to a signal applied to a control terminal 43*a* of the switching unit 43. Although a half bridge circuit is used as the DC-AC converting circuit 13 in the example, it is also possible to use a full bridge circuit.

The capacitor 17, the inductor 19 and primary winding 31 are connected in series between the output 13*a* and the input 13*c* in the DC-AC converting circuit 13. During operation of the lighting circuit 11, a resonant circuit constituted by the capacitor 17 and at least either the inductor 19 or the primary winding 31, is operated. For example, before the discharge lamp 30 is turned on, the secondary winding 33 is set in an open state. Therefore, a series resonance constituted by the capacitor (capacitance C) 17, the inductor (inductance L1) 19 and the primary winding 31 (inductance L2) is generated. A leakage inductance (inductance L3) of the transformer 15 also contributes to the series resonance. In this case, a synthetic inductance is represented by L1+L2+L3. A resonance frequency f1 is defined by 1/(2·πsqrt (C·(L1+L2+L3))). After the discharge lamp 30 is turned on, a series resonance constituted by the capacitor (capacitance C) 17, the inductor (inductance L1) 19, and the leakage inductance (inductance L3) is generated. A resonance frequency f2 is defined by 1/(2·π·sqrt (C·(L1+L3))) (sqrt represents a square root and π represents a circle ratio).

Alternatively, the lighting circuit 11 can utilize a resonant circuit constituted by the capacitor 17 and the primary winding 31. The resonant circuit does not include an additional inductor. Before the discharge lamp 30 is turned on, the secondary winding 33 is set in the open state. Therefore, a series resonance constituted by the capacitor (capacitance C) 17, the primary winding 31 (inductance L2) and the leakage inductance (inductance L3) of the transformer 15 is generated. The resonance frequency f1 is defined by 1/(2·π·sqrt (C·(L2+L3))). After the discharge lamp 30 is turned on, a series resonance constituted by the capacitor (capacitance C) 17 and the leakage inductance (inductance L3) is generated. The resonance frequency f2 is defined by 1/(2·π·sqrt (C·L3)).

The DC-AC converting circuit 13 provides an AC power corresponding to the frequency fc of the control signal Sc to the resonant circuit. The lighting circuit 11 controls the discharge lamp 30 to turn on by utilizing a relationship between the resonance frequency of the resonant circuit and the frequency of the AC power. In order to carry out the control, it is necessary to accurately monitor the state of the discharge lamp 30 (a value of a current flowing to the discharge lamp and a value of a voltage applied to the discharge lamp). A signal for the monitoring is provided from the monitoring output 27 and a monitoring output 47, for example. The monitoring signals have the frequency fc. The monitoring output 47 is connected to an intermediate tap 33*c* of the secondary winding 33, for example. A detecting circuit 49 includes the monitor circuit 29 and a first generating circuit 50. The detecting circuit 49 generates a signal corresponding to the value of the current flowing to the discharge lamp and the value of the voltage applied to the discharge lamp in response to the monitoring signal. A control circuit 52 further includes a frequency modulating circuit 54 connected to an output of the detecting circuit 49. A signal sent from the frequency modulating circuit 54 is provided to the driving circuit 39.

The lighting circuit 11 includes a starting circuit 45. The starting circuit 45 generates a high voltage which is required for turning on the discharge lamp 30. In the example, the starting circuit 45 is connected to an intermediate tap 31*c* of the primary winding 31 and a grounding conductor GND.

Figure 2:
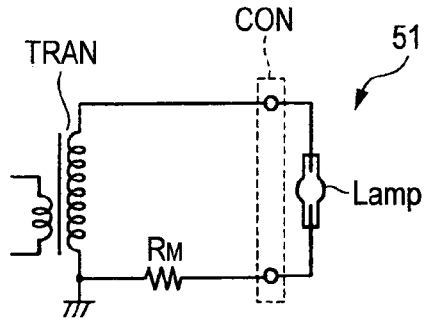
Figure 2:
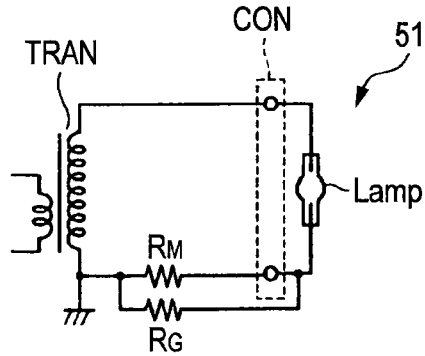
Figure 2:
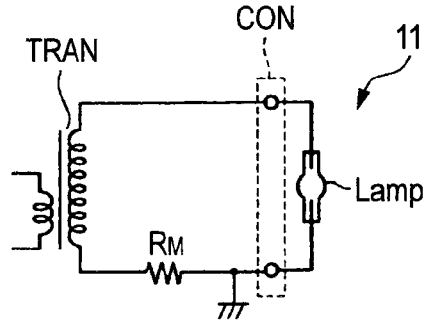
Figure 2:
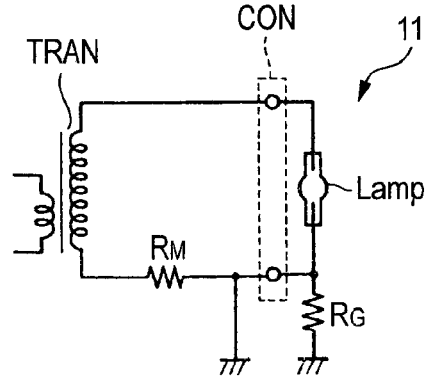

FIGS. 2(*a*) to 2(*d*) are diagrams for explaining an equivalent circuit in the case in which a ground is generated. A discharge lamp Lamp is connected to a lighting circuit through a node CON. In the lighting circuit 51 shown in FIGS. 2(*a*) and 2(*b*), one end of a secondary winding of a transformer TRAN is grounded. Moreover, a current monitoring resistor $R_M$ is connected to one end of the secondary winding of the transformer TRAN and one end (output) of the node CON. When the ground is generated in the lighting circuit 51 and the discharge lamp Lamp, an equivalent resistor $R_G$ caused by the ground is connected in parallel with the monitoring resistor $R_M$ so that a current flowing to the discharge lamp cannot be detected accurately.

On the other hand, in the lighting circuit 11 shown in FIGS. 2(*c*) and 2(*d*), one end of the resistor $R_M$ connected to the node CON is grounded. For this reason, the grounding resistor $R_G$ and the monitoring resistor $R_M$ are not connected in parallel with each other.

As described above, it is possible to provide a lighting circuit capable of monitoring the state of the discharge lamp without the influence of ground. In the control of the lighting circuit, moreover, it is not necessary to consider the ground of the output 23 to which the resistor $R_M$ is connected. Thus, the influence of the ground can be eliminated. Therefore, a fail safe circuit corresponding to the ground of the output of the lighting circuit is not required so that the control circuit can be simplified. As a result, it is possible to reduce the cost of the lighting circuit. As the current flowing to the discharge lamp can be monitored irrespective of the state of the output, it is possible to provide a lighting circuit having high reliability.

Figure 3:
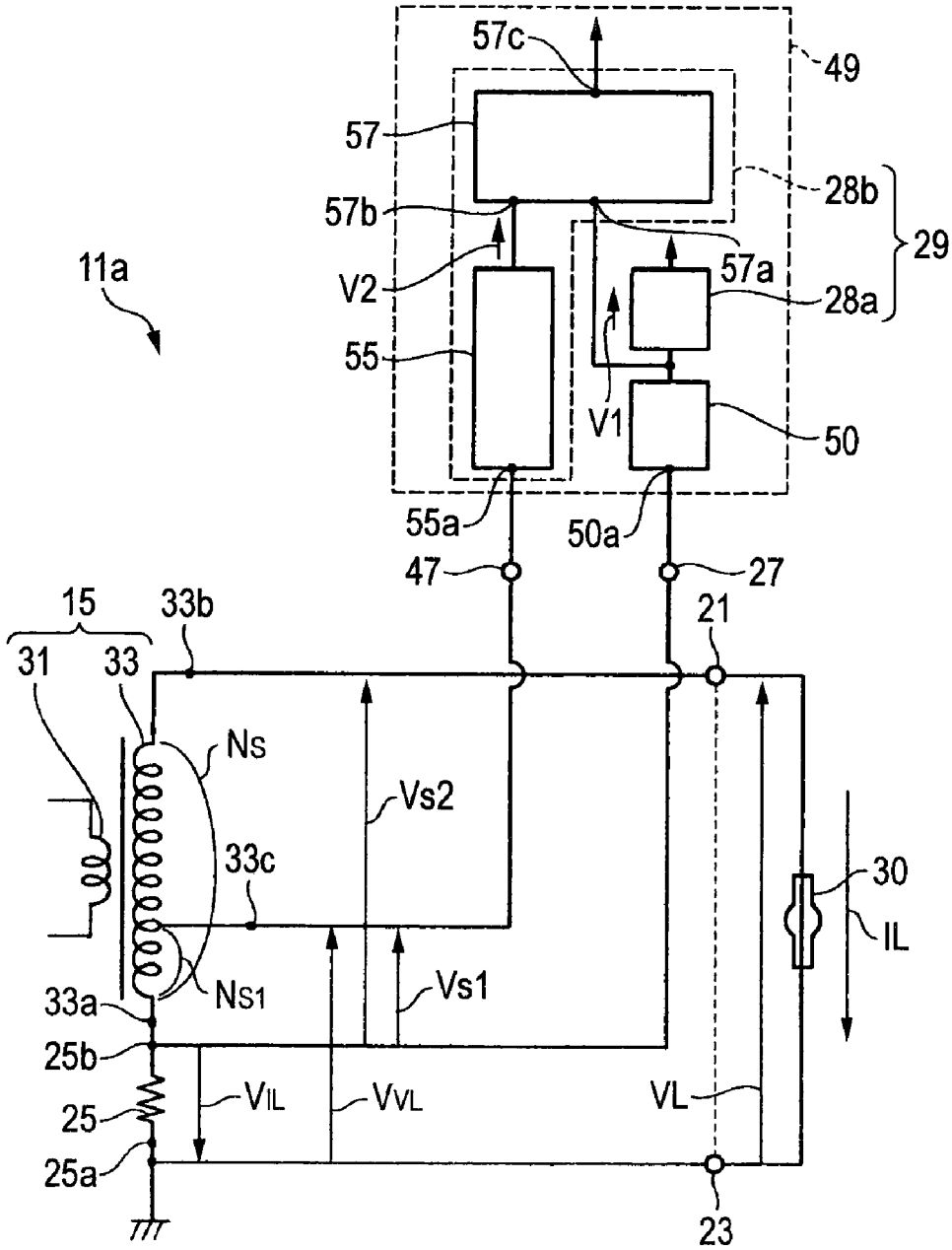
FIG. 3 is a diagram showing an example of a circuit for monitoring a voltage VL to be applied to the discharge lamp.

FIG. 3 is a diagram showing an example of a circuit for monitoring a voltage VL to be applied to the discharge lamp. When the discharge lamp is to be started, a high voltage pulse of approximately 20 kilovolts is applied to the discharge lamp. For this reason, the monitor circuit is connected to the intermediate tap 33*c* of the secondary wiring 33 without directly applying a potential difference $VL^{AC}$ on both ends of the discharge lamp to the monitor circuit in order to monitor the voltage $VL^{AC}$ applied to the discharge lamp. The intermediate tap 33*c* is provided in a position of a winding number of Ns1 from the end 33*a* of the secondary winding 33 with respect to a total number Ns of the secondary winding 33. The end 25*a* of the resistor 25 is grounded. Therefore, the voltage $VL^{AC}$ generated on the intermediate tap 33*c* is a difference between a voltage $Vs1^{AC}$ generated on the partial winding number Ns1 of the transformer 15 and a potential difference $V_{IL}^{AC}$ generated on both ends of the monitoring resistor 25 (a resistance value R1). The value is expressed in the following equation.

$$V_{VL}^{AC}=Vs1^{AC}-V_{IL}^{AC} \tag{1}$$

Moreover, the potential difference $VL^{AC}$ on both ends of the discharge lamp is a sum of a voltage $Vs2^{AC}$ generated between both ends 33*a* and 33*b* of the secondary winding 33 and the potential difference $V_{IL}^{AC}$ generated on both ends of the monitoring resistor 25. As a phase of the voltage $V_{VL}^{AC}$ is opposite that of the voltage $Vs2^{AC}$, the sum of the voltages is expressed in the following equation.

$$VL^{AC}=Vs2^{AC}-V_{IL}^{AC} \tag{2}$$

A voltage Vs2 generated between both ends 33*a* and 33*b* of the secondary winding 33 and a voltage Vs1 generated on the partial winding Ns1 of the transformer 15 are related to a winding ratio of Ns1/Ns. The relationship is expressed in the following equations.

$$Ns1/Ns=Vs1/Vs2 \tag{3}$$

$$Vs2=Vs1\cdot Ns/Ns1 \tag{4}$$

If the potential difference $V_{IL}^{AC}$ of the resistor 25 for detecting a current flowing to the discharge lamp can be disregarded, the voltage $VL^{AC}$ on both of the ends of the discharge lamp is almost equal to $Vs2^{AC}$ based on the equation (2). In the case in which the voltage VL on both ends of the discharge lamp is low, however, the voltage $V_{IL}^{AC}$ cannot be disregarded. For this reason, the contribution of the voltage $V_{IL}^{AC}$ is excluded from the voltage $Vs1^{AC}$ generated on the partial winding Ns1 of the transformer 15 to obtain a monitor voltage for the discharge lamp which does not include the contribution of the voltage $V_{IL}^{AC}$.

For a period in which a current flows in a direction of an arrow IL shown in FIG. 3, positive voltages (effective voltages) $V_L$, $V_{IL}$, $V_{VL}$, Vs1 and Vs2 are generated in the direction of the arrow. With reference to FIG. 3, the two following cases will be described. An absolute value symbol is indicated as "ABS".

(1) Case 1 ($ABS(Vs1^{AC})\geqq ABS(V_{IL}^{AC})$, a direction of an arrow of the intermediate tap voltage $V_{VL}$ is a positive direction)

$$\begin{aligned} V_{VL} &= Vs1+(-V_{IL}) \\ &= Vs2\cdot Ns1/Ns-V_{IL} \\ &= (Ns1/Ns)\cdot(VL-(-V_{IL}))-V_{IL} \\ &= (Ns1/Ns)\cdot VL+((Ns1-Ns)/Ns)\cdot V_{IL} \end{aligned}$$

Accordingly, the following equation is obtained.

$$a\cdot VL=a\cdot(Ns/Ns1)\cdot V_{VL}+a\cdot((Ns-Ns1)/Ns1)\cdot V_{IL}$$

In other words, a·VL is expressed in a sum of first and second terms on a right side. The symbol "a" is a coefficient for converting a lamp voltage VL into a value (a·VL) corresponding to a lamp voltage used in the control circuit 52, and the value of "a" is 0.05, for example.

(2) Case 2 ($ABS(Vs1^{AC})\leqq ABS(V_{IL}^{AC})$, the direction of the arrow of the intermediate tap voltage $V_{VL}$ is a negative direction)

$$\begin{aligned} V_{VL} &= -(Vs1+(-V_{IL})) \\ &= -((Ns1/Ns)\cdot VL+((Ns1-Ns)/Ns)\cdot V_{IL}) \end{aligned}$$

Accordingly, the following equation is obtained.

$$a\cdot VL=-a\cdot(Ns/Ns1)\cdot V_{VL}+a\cdot((Ns-Ns1)/Ns1)\cdot V_{IL}$$

In other words, a·VL is expressed in a difference between the second and first terms on the right side.

In the lighting circuit 11*a*, a detecting circuit 49 generates a signal corresponding to a value of a current flowing to the discharge lamp in response to a signal sent from an end 25*b* of a resistor 25 and, furthermore, processes a signal sent from an intermediate tap 33*c* in a response to a signal sent from the end 25*b* of the resistor 25, thereby generating a signal having the small influence of a potential difference between both of the ends of the resistor 25 (a signal corresponding to a value of a voltage applied to the discharge lamp). The case 1 will be described. The detecting circuit 49 includes a first generating circuit 50, a second generating circuit 55 and a first arithmetic circuit 57. The first generating circuit 50 receives an AC voltage signal sent from the end 25*b* of the resistor 25 at an input 50*a* and generates a first signal V1 corresponding to an amplitude of the AC voltage signal. The first signal V1 corresponds to the signal $V_{IL}^{AC}$, for example. The first signal V1 is provided to a current monitor circuit 28*a*. The second generating circuit 55 of a voltage monitor circuit 28*b* receives an AC voltage signal sent from an intermediate tap 33*c* at an input 55*a* and generates a second signal V2 corresponding to an amplitude of the AC voltage signal. The second signal V2 corresponds to the signal $V_{VL}^{AC}$, for example. The first and second signals V1 and V2 are provided to the first arithmetic circuit 57. The first arithmetic circuit 57 receives the first and second signals V1 and V2 at inputs 57*a* and 57*b* respectively, and calculates (adds in the case 1) the first signal V1 and the second signal V2, thereby generating a lamp voltage equivalent signal. The first arithmetic circuit 57 has an output 57*c* for providing a signal corresponding to a X VL.

In the lighting circuit 11*a*, an end 25*a* of the resistor 25 is grounded. Therefore, a value of an output from the intermediate tap 33*c* of a transformer 15 includes both a voltage Vs1 generated between an end 33*a* of a secondary winding 33 and the intermediate tap 33*c* and a voltage $V_{IL}$ between both ends of the resistor 25. If the voltages are processed by using the detecting circuit 49, the influence of a voltage drop through the resistor 25 can be substantially eliminated.

In the lighting circuit 1*a*, it is preferable that the first generating circuit 50 include a peak detecting circuit for receiving a signal from the input 50*a*. The first signal V1 indicates a peak value of the signal received at the input 50*a*. For this reason, $V1=V_{IL}\cdot\text{sqrt}(2)$ is obtained. Moreover, it is preferable that the second generating circuit 55 should include a peak detecting circuit for receiving the signal from the input 55*a*. The second signal V2 indicates a peak value of the signal received at the input 55*a*. For this reason, $V2=V_{VL}\cdot\text{sqrt}(2)$ is obtained. According to the lighting circuit 11*a*, it is possible to generate a signal corresponding to a current flowing to the discharge lamp and a voltage applied to the discharge lamp by using the respective peak values. Moreover, each of the peak detecting circuits includes a clamp circuit for clamping a negative voltage to be applied to the inputs 50*a* and 55*a* and a peak hold circuit for holding a peak value of an output of the clamp circuit.

Figure 4:
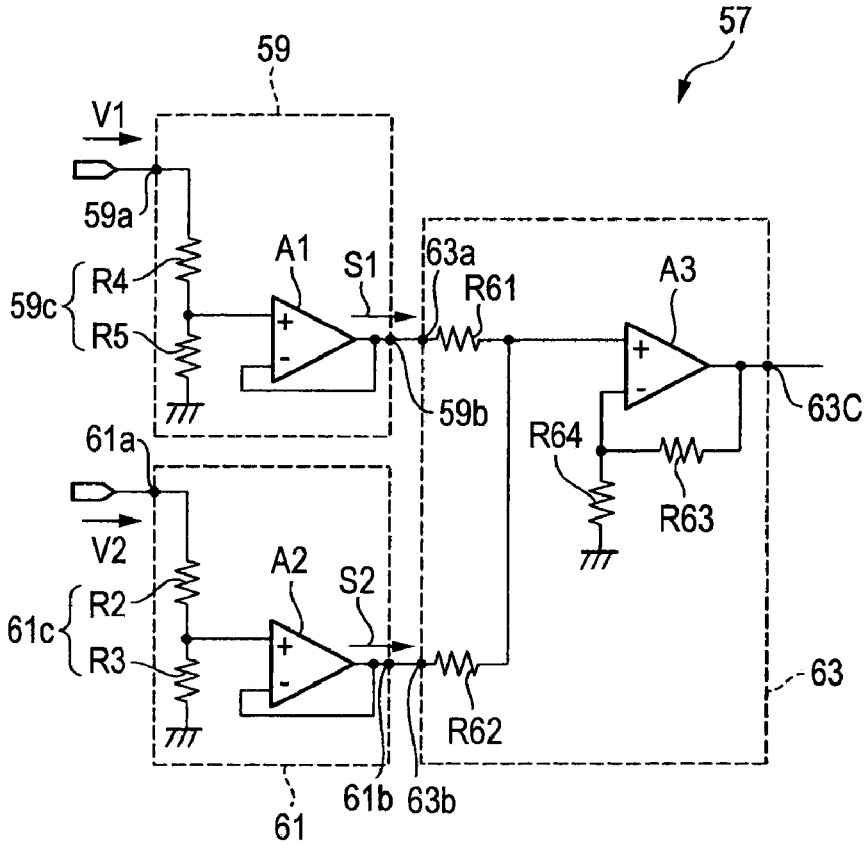
FIG. 4 is a diagram sowing an example of a first arithmetic circuit.

FIG. 4 is a diagram showing an example of the first arithmetic circuit. The first arithmetic circuit 57 generates a first signal S1 obtained by dividing the first signal V1 at a voltage dividing ratio D1 and a second signal S2 obtained by dividing the second signal V2 at a voltage dividing ratio D2, and a sum or a difference of the first and second signals V1 and V2 is calculated to generate a signal for monitoring the voltage to be applied to the discharge lamp. More specifically, a first processing circuit 59 receives the first signal V1 indicative of the peak value of the voltage $V_{IL}^{AC}$ at an input 59*a* and generates the first signal S1 which is proportional to $V_{IL}\cdot(Ns-Ns1)/Ns1$, and furthermore, has an output 59*b* for providing the first signal S1. A second processing circuit 61 receives the second signal V2 indicative of the peak value of the voltage $V_{VL}^{AC}$ at an input 61*a*, and generates the second signal S2 which is proportional to $V_{VL}\cdot Ns/Ns1$, and furthermore, has an output 61*b* for providing the second signal 32. An adding circuit 63 receives the first signal S1 and the second signal S2 at first and second inputs 63*a* and 63*b* respectively, carries out an addition (in the case 2, a subtraction) of the first signal S1 and the second signal S2, and provides a third signal S3 indicative of an added value (in the case 2, a subtracted value) to an output 63*c*. In the example, the voltage dividing ratio D1 is related to $[a\cdot(Ns-Ns1)/Ns1/\text{sqrt}(2)]$ and the voltage dividing ratio D2 is related to $[a\cdot Ns/Ns1/\text{sqrt}(2)]$. [D2−D1] is related to [a/sqrt (2)].

The first processing circuit 59 includes a voltage dividing circuit 59*c* formed by connecting a resistor R4 and a resistor R5 in series between the input 59*a* and a ground GND. A node of the resistor R4 and the resistor R5 is connected to a non-inverting input of an operational amplifier A1, and the non-inverting input receives a voltage dividing value obtained by the resistors R4 and R5. An inverting input of the operational amplifier A1 is connected to an output of the operational amplifier A1. The output of the operational amplifier A1 is connected to the output 59*b* of the first processing circuit 59.

The second processing circuit 61 includes a voltage dividing circuit 61*c* formed by connecting a resistor R2 and a resistor R3 in series between the input 61*a* and a ground GND. A node of the resistor R2 and the resistor R3 is connected to a non-inverting input of an operational amplifier A2, and the non-inverting input receives a voltage dividing value obtained by the resistors R2 and R3. An inverting input of the operational amplifier A2 is connected to an output of the operational amplifier A2. The output of the operational amplifier A2 is connected to the output 61*b* of the second processing circuit 61.

The adding circuit 63 includes an operational amplifier A3. The input 63*a* of the adding circuit 63 is connected to a non-inverting input of the operational amplifier A3 through resistor R61. The other input 63*b* of the adding circuit is connected to the non-inverting input of the operational amplifier A3 through resistor R62. An inverting input of the operational amplifier A3 is connected to an output of the operational amplifier A3 through a resistor R63 and, furthermore, is grounded through a resistor R64.

In the first processing circuit 59, values of the resistors R4 and R5 are determined in such a manner that the first signal S1 is $[a\cdot V_{IL}\cdot(Ns-Ns1)/Ns1]$. In the second processing circuit 61, moreover, values of the resistors R2 and R3 are determined in such a manner that the second signal S2 is $a\cdot V_{VL}\cdot Ns/Ns1$. At this time, the following relationship is satisfied by $V1=V_{IL}\cdot\text{sqrt}(2)$ and $V2=V_{VL}\cdot\text{sqrt}(2)$.

$$R3/(R2+R3)=a\cdot Ns/Ns1/\text{sqrt}(2)$$

$$R5/(R4+R5)=a\cdot(Ns-Ns1)/Ns1/\text{sqrt}(2)$$

If R61=R62 is set, a mean value of the signals S1 and S2 is input at the non-inverting input of the operational amplifier A3. If R63=R64 is set, the mean value is amplified to be a double by using the operational amplifier A3 so that a X VL appears on the output of the adding circuit 63. Consequently, the case 1 has been described in detail.

Result of case 1

$$a\cdot VL=a\cdot(Ns/Ns1)\cdot V_{VL}+a\cdot(Ns-Ns1)/Ns1\cdot VIL$$

Result of case 2

$$a\cdot VL=-a\cdot(Ns/Ns1)\cdot V_{VL}+a\cdot(Ns-Ns1)/Ns1\cdot VIL$$

By comparing them, it can be understood that a subtracting circuit is preferably used as the circuit for the case 2 in place of the adding circuit. Based on a VL detecting range and an IL detecting range, whether either the circuit for the case 1 or the case 2 is used is determined depending on a relationship between Vs1 (=Ns1/Ns·(VL+IL·R1)) and VIL (=IL·R1).

With reference to FIG. 3, the detecting circuit 49 provides the signal V1 from the first generating circuit 50 to the first arithmetic circuit 57. However, the second generating circuit 55 can receive the AC voltage signal from the other end 25*b* of the resistor 25, and furthermore, can add the same signal to the signal V2, thereby generating a signal corresponding to the amplitude of the AC voltage signal (an equivalent signal to the signal V1). In the detecting circuit, the first arithmetic circuit is operated in response to two signals sent from the second generating circuit 55.

Figure 5:
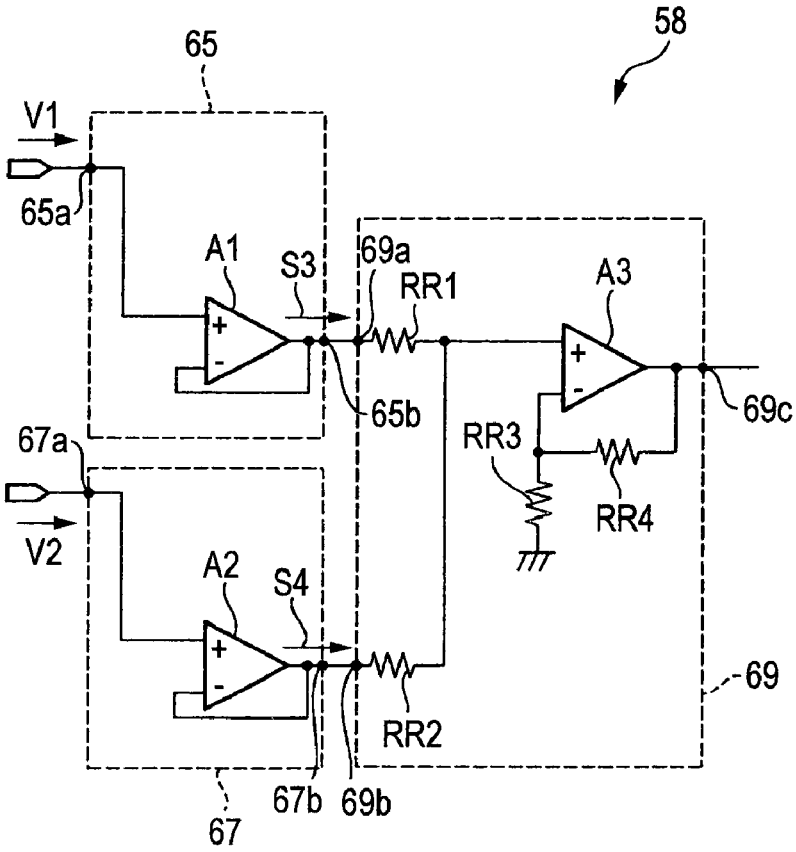
FIG. 5 is a diagram showing another example of the first arithmetic circuit.

FIG. 5 is a diagram showing another example of the first arithmetic circuit. A first arithmetic circuit 58 does not include the voltage dividing circuit. In the first arithmetic circuit 58, a third processing circuit 65 generates a signal S3 in response to the signal V1 and includes a voltage follower circuit. A non-inverting input of an operational amplifier A1 receives the first signal V1 through an input 65*a*. An inverting input of the operational amplifier A1 is connected to an output of the operational amplifier A1. The output of the operational amplifier A1 is connected to an output 65*b* of the third processing circuit 65. A fourth processing circuit 67 generates a signal S4 in response to the signal V2, and includes a voltage follower circuit. A non-inverting input of an operational amplifier A2 receives the second signal V2 through an input 67*a*. An inverting input of the operational amplifier A2 is connected to an output of the operational amplifier A2. The output of the operational amplifier A2 is connected to an output 67*b* of the fourth processing circuit 67. An adding circuit 69 includes an operational amplifier A3. An input 69*a* of the adding circuit 69 is connected to a non-inverting input of the operational amplifier A3 through a resistor RR1. Another input 69*b* of the adding circuit 69 is connected to the non-inverting input of the operational amplifier A3 through a resistor RR2. An inverting input of the operational amplifier A3 is connected to an output of the operational amplifier A3 through a resistor RR4, and furthermore, is grounded through a resistor RR3.

An output value $V_{OUT}$ of the adding circuit 69 is obtained as follows.

$$V_{OUT} = (V_{VL} \cdot sqrt(2)) \cdot (RR2/RR3) \cdot ((RR3 + RR4)/(RR1 + RR2)) + (V_{IL} \cdot sqrt(2)) \cdot (RR1/RR3) \cdot ((RR3 + RR4)/(RR1 + RR2)).$$

On the other hand, according to the result of the case 1, the following equation is obtained.

$$a \cdot VL = a \cdot (Ns/Ns1) \cdot V_{VL} + a \cdot ((Ns - Ns1)/Ns1) \cdot V_{IL}$$

By comparing the terms of $V_{VL}$ and $V_{IL}$, the following equations are obtained.

$$(RR2/RR3) \cdot ((RR3+RR4)/(RR1+RR2)) = a \cdot Ns/Ns1/\mathrm{sqrt}(2)$$

$$(RR1/RR3) \cdot ((RR3+RR4)/(RR1+RR2)) = a \cdot (Ns - Ns1)/Ns1/\mathrm{sqrt}(2)$$

From the equations, it is possible to obtain the relationship between the resistors RR1 and RR2 and the relationship between the resistors RR3 and RR4. Referring to the case 2, similarly, it is possible to set a resistance value by the same calculation. As is understood from the description, various variants can be proposed for the circuit constituting the detecting circuit.

Second Embodiment

Figure 6:
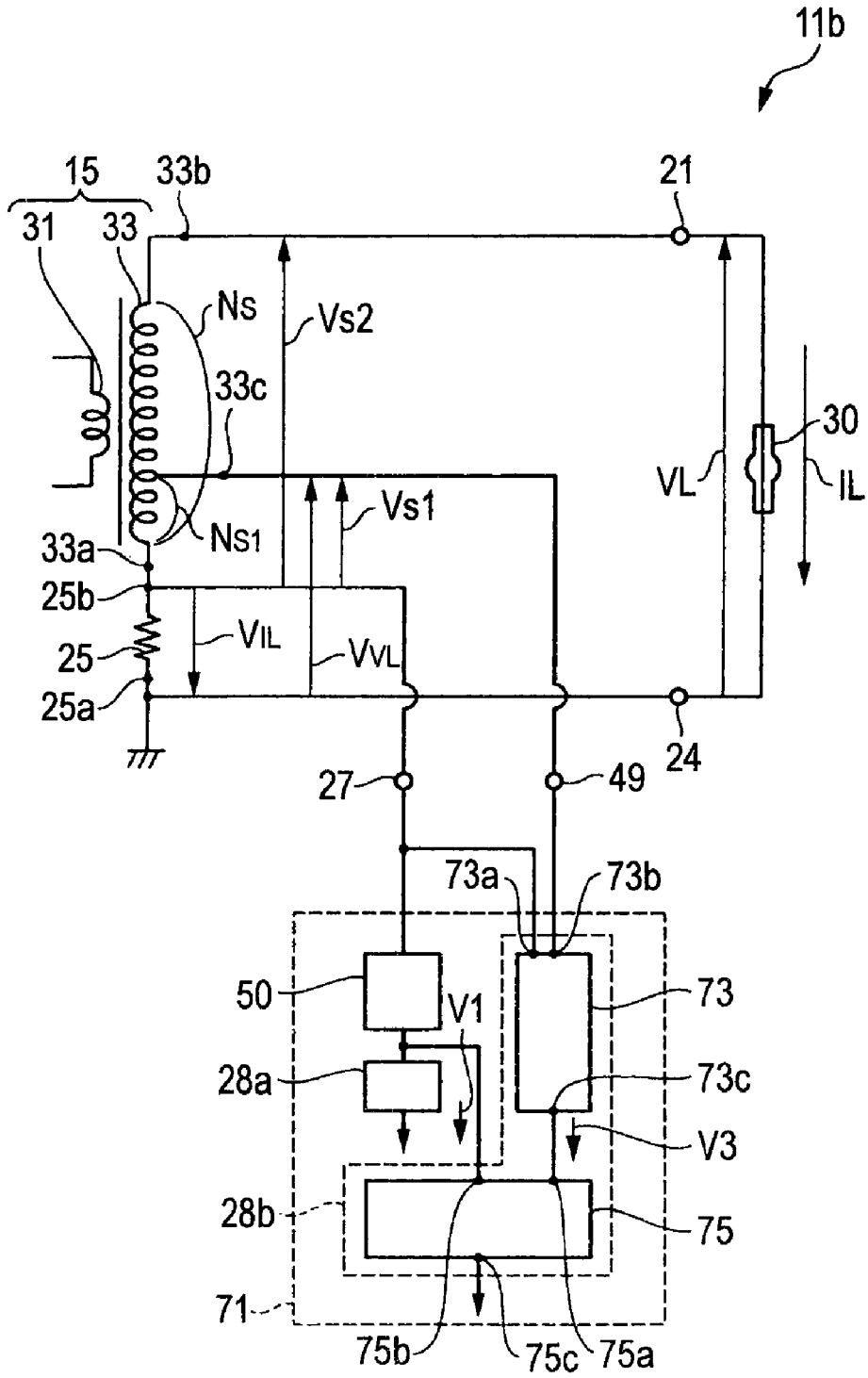
FIG. 6 is a diagram showing an example of the circuit for monitoring the voltage VL to be applied to the discharge lamp.

FIG. 6 is a diagram showing a further example of the detecting circuit. In the lighting circuit 11*b*, a detecting circuit 71 generates a voltage signal corresponding to a difference value between a signal sent from an end 25*b* of a resistor 25 (a signal corresponding to a value of a current flowing to a discharge lamp) and a signal sent from an intermediate tap and, furthermore, processes the voltage signal and a signal generated in response to the signal sent from the end 25*b* of the resistor 25 to generate a signal in which the influence of a potential difference between both ends of the resistor 25 is reduced in the signal sent from the intermediate tap (a signal corresponding to a value of a voltage applied to the discharge lamp). In the lighting circuit 11*b*, the detecting circuit 71 includes a first generating circuit 50, a third generating circuit 73 and a second arithmetic circuit 75. The third generating circuit 73 has a first input 73*a* connected to the end 25*b* of the resistor 25 and a second input 73*b* connected to an intermediate tap 33*c*, and generates a third signal V3 corresponding to a difference between AC signals sent from the first and second inputs 73*a* and 73*b*. The third signal V3 is a signal corresponding to a potential difference $Vs1^{AC}$ shown in FIG. 6. The second arithmetic circuit 75 calculates a first signal V1 and the third signal V3, thereby generating a lamp voltage equivalent signal. For this reason, the second arithmetic circuit 75 generates a signal corresponding to a·VL by using a signal corresponding to the potential difference $Vs1^{AC}$ and a signal corresponding to a value of a current flowing to the discharge lamp. The signal is provided to an output 75*c*.

As shown in FIG. 6, a direction of a voltage $V_{IL}^{AC}$ is reverse to that of a voltage $V_{VL}^{AC}$. For example, when the voltage $V_{VL}^{AC}$ has a positive maximum amplitude, the voltage $VL^{AC}$ has a negative maximum amplitude. The signal $Vs1^{AC}$ indicative of a difference is an AC signal in which a sum of the maximum amplitude value (positive value) of $V_{IL}^{AC}$ and the maximum amplitude value (positive value) of $V_{VL}^{AC}$ is a maximum amplitude.

According to the lighting circuit 11*b*, a value of an output from the intermediate tap 33*c* is used without directly monitoring a voltage between both of the terminals of the discharge lamp to which a high voltage is applied. Therefore, it is possible to reduce a breakdown performance of a monitor input portion, and furthermore, to cause a signal indicative of the voltage to be applied to the discharge lamp to have high precision. Moreover, an end 25*a* of the resistor 25 is grounded. Therefore, the value of the output from the intermediate tap 33*c* is a sum of a voltage Vs1 generated between an end 33*a* of a secondary winding 33 and the intermediate tap 33*c* and the voltage between both of the ends of the resistor 25. By processing the voltage signals sent from the first and third generating circuits using the second arithmetic circuit 75, it is possible to substantially eliminate the influence of the resistor 25. Consequently, it is possible to obtain a signal indicative of a potential difference between the intermediate tap 33*c* and the end 25*b* of the resistor 25.

Figure 7:
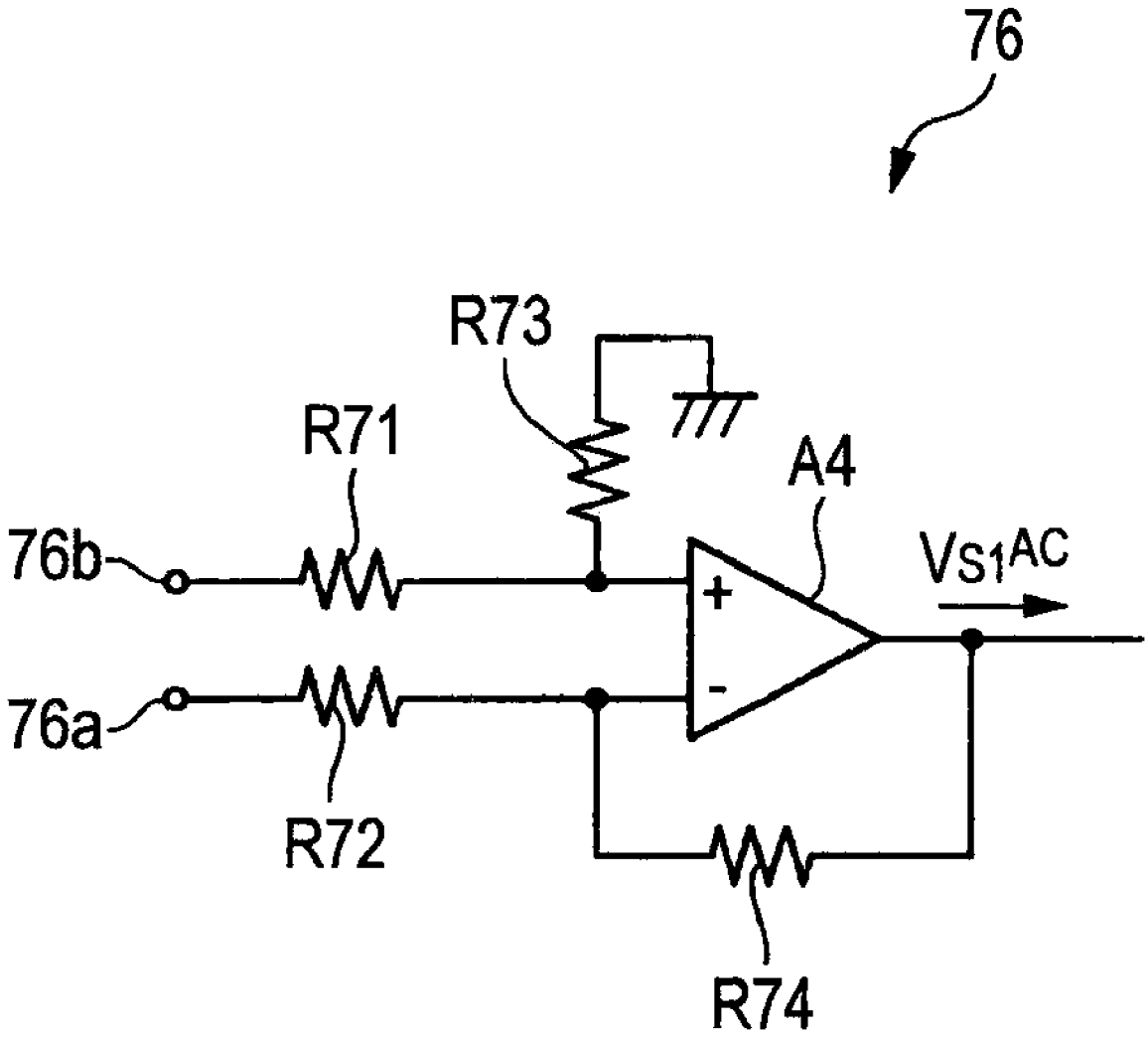
FIG. 7 is a diagram showing an example of a part of a structure of a third generating circuit.

FIG. 7 is a diagram showing an example of a part of a structure of the third generating circuit. The third generating circuit 73 includes a subtracting circuit 76. The subtracting circuit 76 generates a voltage signal corresponding to a difference value of the signals sent through the inputs 73*a* and 73*b*. A first input 76*a* of the subtracting circuit 76 is connected to an inverting input of an operational amplifier A4 through a resistor R72. The inverting input of the operational amplifier A4 is connected to an output of the operational amplifier A4 through a resistor R74. Moreover, a second input 76*b* of the subtracting circuit 76 is connected to a non-inverting input of the operational amplifier A4 through a resistor R71, and a non-inverting input of the operational amplifier A4 is grounded through a resistor R73.

The first input 76*a* is connected to the input 73*a* of the third generating circuit 73 (an input signal is $V_{IL}^{AC}$), and the second input 76*b* is connected to the input 73*b* of the third generating circuit 73 (an input signal is $V_{VL}^{AC}$) By setting the resistors R71=R72=R73=R74, moreover, the following relationship can be obtained, wherein the output signal of the operational amplifier A4 is described as an AC voltage VF3$^{AC}$.

$$VF3^{AC}=V_{VL}^{AC}-V_{IL}^{AC}=Vs1^{AC}$$

A peak value obtained by causing the signal Vs1$^{AC}$ to pass through a peak hold circuit is a signal V3 (=Vs1·sqrt(2)). By the circuit, a difference between the values of the input voltages is provided so that a signal corresponding to the voltage Vs1$^{AC}$ is generated. By using a relationship of a winding ratio of the transformer 15

$$Ns1/Ns=Vs1/Vs2,$$

it is possible to obtain $$a\cdot Vs2=a\cdot Vs1\cdot Ns/Ns1$$

Also in the lighting circuit 11*b*, the third generating circuit 73 can include the same peak detecting circuit as in the lighting circuit 11*a*. According to the lighting circuit 11*b*, it is possible to generate a signal corresponding to a current flowing to a discharge lamp and a voltage applied to the discharge lamp by using a peak value of a difference value obtained as an AC signal. Moreover, the peak detecting circuit includes a clamp circuit and a peak hold circuit.

A signal corresponding to a·Vs2 is generated by using a circuit for dividing a signal corresponding to V3 at a voltage dividing ratio D3 (for example, a voltage dividing resistor and a voltage follower circuit) as shown in FIG. 4 after obtaining the peak value V3 of Vs1$^{AC}$. The voltage dividing ratio D3 is related to a·Ns/Ns1/sqrt (2).

If a potential difference between both ends of the resistor 25 is small, the following equation is substantially obtained.

$$\begin{aligned} a\cdot VL &= a\cdot Vs2 \\ &= a\cdot Vs1\cdot Ns/Ns1 \\ &= a\cdot V3\cdot Ns/Ns/Ns1/sqrt(2) \end{aligned}$$

In consideration of the potential difference between both of the ends of the resistor 25, the following equation is obtained.

$$\begin{aligned} a\cdot VL &= a\cdot Vs2-a\cdot V_{IL} \\ &= a\cdot Vs1\cdot Ns/Ns1-a\cdot V_{IL} \\ &= a\cdot V3\cdot Ns/Ns1/sqrt(2)-a\cdot V1/sqrt(2) \end{aligned}$$

By using the subtracting circuit to generate a difference between the signal corresponding to Vs1$^{AC}$ and $V_{IL}^{AC}$, therefore, it is possible to obtain a·VL to be a lamp voltage equivalent signal.

Although the detecting circuit 71 provides the signal V1 from the first generating circuit 50 to the second arithmetic circuit 75, the third generating circuit 73 receives the AC voltage signal from the end 25*b* of the resistor 25, and furthermore, can generate a signal corresponding to an amplitude of the AC voltage signal (a signal which is equivalent to the signal V1) in addition to the signal V3. In the detecting circuit, the second arithmetic circuit is operated in response to two signals sent from the third generating circuit.

Third Embodiment

Figure 8:
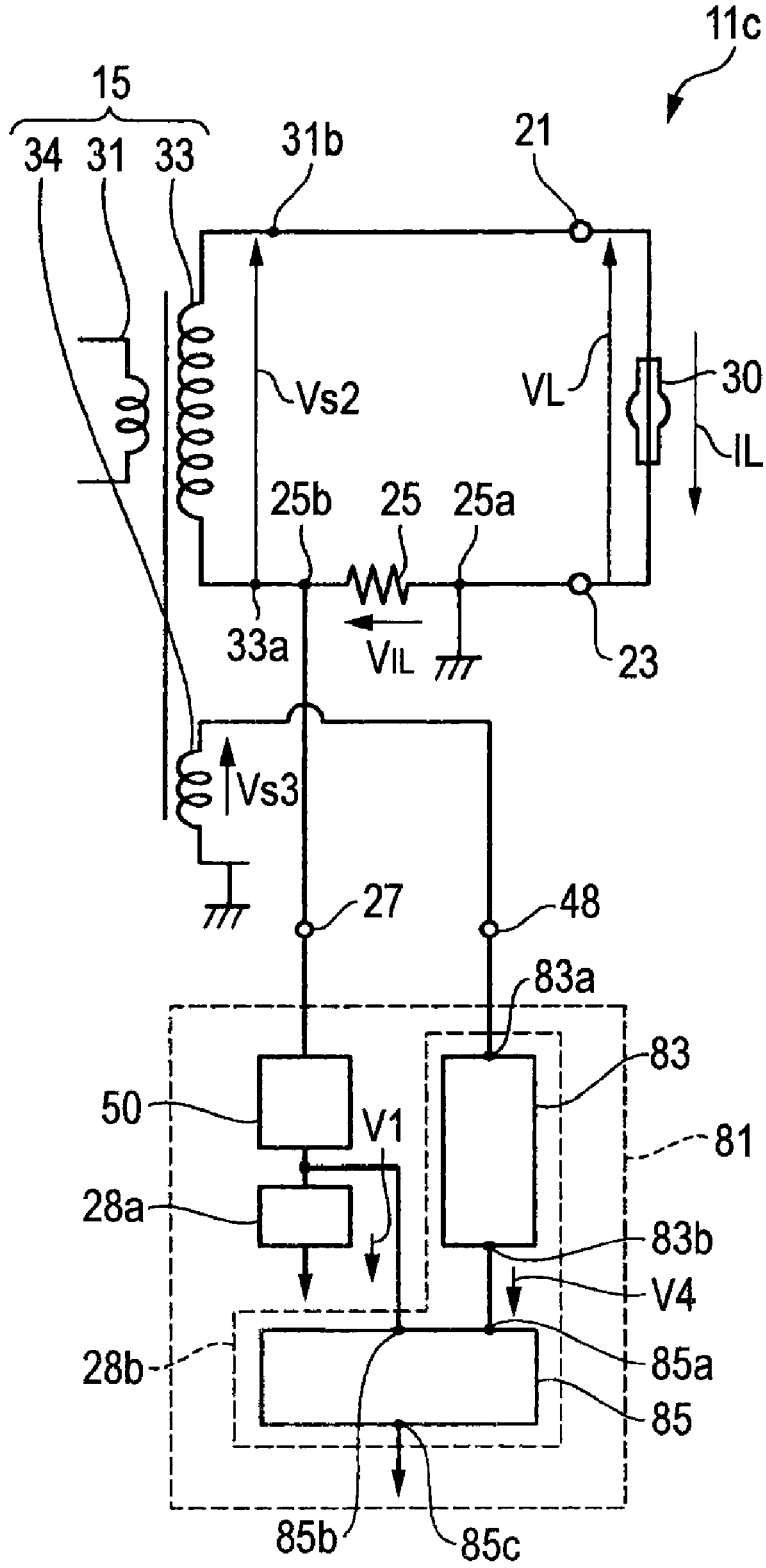
FIG. 8 is a diagram showing an example of the circuit for monitoring the voltage VL to be applied to the discharge lamp.

FIG. 8 is a diagram showing a further example of the detecting circuit. In the lighting circuit 11*c*, a secondary side of a transformer 15 includes an additional winding 34 (a winding number of Ns3). If the additional winding 34 is provided on the secondary side of the transformer 15, an intermediate tap is not used. A detecting circuit 81 includes a first generating circuit 50, a fourth generating circuit 83 and a third arithmetic circuit 85. The fourth generating circuit 83 has an input 83*a* connected to the additional winding 34 through a monitoring output 48, and furthermore, generates a fourth signal V4 depending on an AC voltage corresponding to a potential difference between both ends of the additional winding 34. The third arithmetic circuit 85 calculates a first signal V1 and the fourth signal V4 to output a lamp voltage equivalent signal. The fourth signal V4 corresponds to a maximum amplitude value of Vs3$^{AC}$. By using a relationship of a winding ratio of a secondary winding 33 to the additional winding 34

$$Ns3/Ns=Vs3/Vs2,$$

it is possible to obtain $$a\cdot Vs2=a\cdot Vs3\cdot Ns/Ns3.$$

Also in the lighting circuit 11*c*, it is preferable that the fourth generating circuit 83 should include a peak detecting circuit for receiving a signal from the input 83*a* in the same manner as in the lighting circuits 11*a* and 11*b*. The fourth signal V4 indicates a peak value of a signal received by the input 83*a*.

If a potential difference between both ends of the resistor 25 is small, the following equation is substantially obtained.

$$\begin{aligned} a\cdot VL &= a\cdot Vs2 \\ &= a\cdot Vs3\cdot Ns/Ns3 \\ &= a\cdot V4\cdot Ns/Ns3/sqrt(2) \end{aligned}$$

In consideration of the potential difference between both of the ends of the resistor 25, the following equation is obtained.

$$\begin{aligned} a\cdot VL &= a\cdot Vs2-a\cdot V_{IL} \\ &= a\cdot Vs3\cdot Ns/Ns3-a\cdot V_{IL} \\ &= a\cdot V4\cdot Ns/Ns3/sqrt(2)-a\cdot V1/sqrt(2) \end{aligned}$$

The third calculating circuit 85 has an input 85*a* for receiving a signal corresponding to Vs3$^{AC}$ and an input 85*b* for receiving a signal corresponding to $V_{IL}^{AC}$, and generates a difference signal between the signal V4 corresponding to Vs3$^{AC}$ and a value obtained by dividing the signal V1 corresponding to $V_{IL}^{AC}$ into (a·Ns/Ns3/sqrt (2)) and (a/sqrt (2)). If the potential difference between both of the ends of the resistor 25 is small, it is not necessary to provide a subtracting circuit for subtracting −a·V1/sqrt (2). The third calculating circuit 85 has an output 85*c* for providing a signal corresponding to a·VL.

Although the detecting circuit 81 provides the signal V1 from the first generating circuit 50 to the third arithmetic circuit 85, the fourth generating circuit 83 receives the AC voltage signal from the end 25*b* of the resistor 25, and furthermore, can generate a signal corresponding to an amplitude of the AC voltage signal (a signal which is equivalent to the signal V1) in addition to the signal V4. In the detecting circuit, the third arithmetic circuit is operated in response to two signals sent from the fourth generating circuit.

Fourth Embodiment

Figure 9:
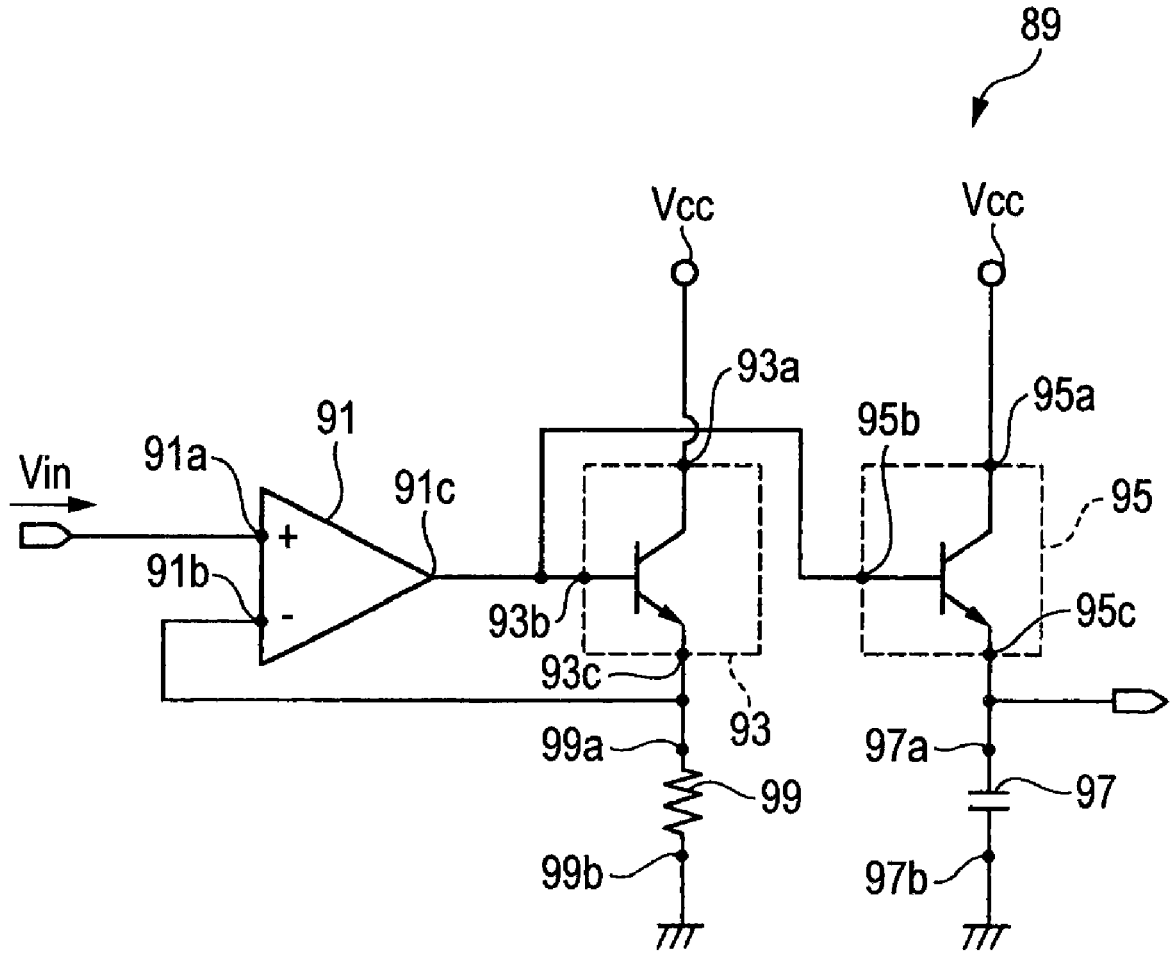
FIG. 9 is a diagram showing a peak hold circuit to be used in the lighting circuit.

FIG. 9 is a diagram showing a peak hold circuit to be used in the lighting circuits 11*a*, 11*b* and 11*c*. A peak hold circuit 89 includes an operational amplifier 91, a first transistor 93, a second transistor 95, a holding capacitor 97 and a resistor 99. The operational amplifier 91 has a non-inverting input 91*a* for receiving an input signal Vin, an inverting input 91*b* and an output 91*c*. Each of the first transistor 93 and the second transistor 95 can be a bipolar transistor or a field effect transistor. When the first transistor 93 is the bipolar transistor (the field effect transistor), the first transistor 93 has a collector (a drain) 93*a* connected to a power line Vcc, a base (a gate) 93*b* connected to the output 91*c* of the operational amplifier 91, and an emitter (a source) 93*c* connected to the inverting input 91*b* of the operational amplifier 91 and an end 99*a* of the resistor 99. When the second transistor 95 is the bipolar transistor (the field effect transistor), the second transistor 95 has a collector (a drain) 95*a* connected to a power line Vcc, a base (a gate) 95*b* connected to the output 91*c* of the operational amplifier 91, and an emitter (a source) 95*c* connected to an end 97*a* of a capacitor 97. An end 97*b* of the capacitor 97 and an end 99*b* of the resistor 99 are grounded.

The output of the operational amplifier 91 is connected to the base 93*b* of the transistor 93, and furthermore, the emitter 93*c* of the transistor 93 is connected to the inverting input 91*b* of the operational amplifier 91. Therefore, the first transistor 93 is provided for a negative feedback. Moreover, the output of the operational amplifier 91 is connected to the base 95*b* of the transistor 95, and furthermore, the emitter 95*c* of the transistor 95 is connected to the end 97*a* of the capacitor 97. Therefore, the second transistor 95 is provided for holding a peak voltage. For this reason, the operational amplifier 91 is operated without a saturation of an output. Therefore, a frequency band of the peak hold circuit 89 is wide, that is, almost equal to that of the operational amplifier 91. When an input frequency is present in the frequency band, the peak hold circuit 89 is operated in accordance with a change in an input signal.

If necessary, the peak hold circuit 80 can further include a resistor connected in parallel with the capacitor 97.

In the lighting circuits 11*a*, 11*b* and 11*c*, in the case in which a restriking voltage taking a shape of a larger pulse than an amplitude of an AC signal is generated every time a polarity of an alternating current is switched, it is necessary to mask the restriking voltage, thereby detecting an amplitude (a peak value of the AC signal) of a lamp voltage.

A signal is generated in response to a switching frequency of the DC-AC converting circuit 13 in the monitoring outputs 27, 47 and 48 of the lighting circuits 11*a*, 11*b* and 11*c*. The monitor circuit is to be operated in response to the switching frequency. However, the peak hold circuit usually includes a holding capacitor connected to the output of the operational amplifier. In many cases, therefore, an operating upper limited frequency is determined by a capacitance value of the capacitor. By using the peak hold circuit 89, however, a monitor signal responds to almost the same degree as the frequency band of the operational amplifier 91.

As described above, according to the lighting circuit in accordance with an embodiment, even if a ground is generated, it is possible to accurately monitor a lamp voltage and a lamp current, thereby carrying out a power calculation. Therefore, it is possible to prevent a situation in which an excessive power is supplied to a discharge lamp and to safely detect the ground.

The invention is not restricted to the specific structures disclosed in the embodiments described above. Accordingly, other implementations are within the scope of the claims.

What is claimed is:

1. A lighting circuit for turning on a discharge lamp, the lighting circuit comprising:

a DC-AC converting circuit to convert an input DC voltage into an AC voltage in response to a control signal for controlling power to be applied to the discharge lamp;

a transformer including a primary winding to receive the AC voltage from output of the DC-AC converting circuit, and further including a secondary winding;

a capacitor on the primary side of the transformer;

an inductor on the primary side of the transformer;

first and second outputs for supplying a power from the secondary winding to the discharge lamp;

a resistor having one end connected to the second output and grounded and the other end connected to one end of the secondary winding; and a detecting circuit including a current monitor circuit for monitoring a current flowing to the discharge lamp by using a signal from the other end of the resistor, wherein the capacitor, the inductor and the primary winding are connected in series, and wherein:

the secondary winding of the transformer has an intermediate tap, the detecting circuit has a first generating circuit having an input connected to the other end of the resistor, and the detecting circuit has a voltage monitor circuit, the first generating circuit is operable to generate a first signal corresponding to an amplitude of the AC voltage at the input, and the voltage monitor circuit includes:

a second generating circuit having an input connected to the intermediate tap and operable to generate a second signal corresponding to the amplitude of the AC voltage at the input; and a first arithmetic circuit for processing the first signal and the second signal to output a lamp voltage equivalent signal.

2. The lighting circuit according to claim 1, wherein the first generating circuit includes a holding circuit to hold and output a signal corresponding to an amplitude of a signal sent from the input of the first generating circuit.

3. A lighting circuit for turning on a discharge lamp, the lighting circuit comprising:

a DC-AC converting circuit to convert an input DC voltage into an AC voltage in response to a control signal for controlling power to be applied to the discharge lamp;

a transformer including a primary winding to receive the AC voltage from output of the DC-AC converting circuit, and further including a secondary winding;

a capacitor on the primary side of the transformer;

an inductor on the primary side of the transformer;

first and second outputs for supplying a power from the secondary winding to the discharge lamp;

a resistor having one end connected to the second output and grounded and the other end connected to one end of the secondary winding; and a detecting circuit including a current monitor circuit for monitoring a current flowing to the discharge lamp by using a signal from the other end of the resistor, wherein the capacitor, the inductor and the primary winding are connected in series, and wherein:

the secondary winding of the transformer has an intermediate tap, the detecting circuit has a first generating circuit having an input connected to the other end of the resistor, and the detecting circuit has a voltage monitor circuit, the first generating circuit is operable to generate a first signal corresponding to an amplitude of the AC voltage at the input, and the voltage monitor circuit includes:

another generating circuit having a first input connected to the other end of the resistor and a second input connected to the intermediate tap of the secondary winding, and operable to generate another signal corresponding to a difference between AC signals sent from the first and second inputs; and another arithmetic circuit for processing the first signal and the other signal to output a lamp voltage equivalent signal.

4. The lighting circuit according to claim 3, wherein the first generating circuit includes a holding circuit to hold and output a signal corresponding to an amplitude of a signal sent from the input of the first generating circuit.

5. A lighting circuit for turning on a discharge lamp, the lighting circuit comprising:

a DC-AC converting circuit to convert an input DC voltage into an AC voltage in response to a control signal for controlling power to be applied to the discharge lamp;

a transformer including a primary winding to receive the AC voltage from output of the DC-AC converting circuit, and further including a secondary winding;

a capacitor on the primary side of the transformer;

an inductor on the primary side of the transformer;

first and second outputs for supplying a power from the secondary winding to the discharge lamp;

a resistor having one end connected to the second output and grounded and the other end connected to one end of the secondary winding; and a detecting circuit including a current monitor circuit for monitoring a current flowing to the discharge lamp by using a signal from the other end of the resistor, wherein the capacitor, the inductor and the primary winding are connected in series, and wherein:

the secondary side of the transformer has an additional winding, the detecting circuit includes a first generating circuit having an input connected to the other end of the resistor, and the detecting circuit has a voltage monitor circuit, the first generating circuit generates a first signal corresponding to an amplitude of the AC voltage at the input, and the voltage monitor circuit includes:

another generating circuit having an input connected to the additional winding and operable to generate another signal depending on an amplitude of an AC voltage corresponding to a potential difference between both ends of the additional winding; and another arithmetic circuit for processing the first signal and the other signal to output a lamp voltage equivalent signal.

6. The lighting circuit according to claim 5, wherein the first generating circuit includes a holding circuit to hold and output a signal corresponding to an amplitude of a signal sent from the input of the first generating circuit.

* * * * *